United States Patent [19]

Renz

[11] Patent Number: 4,619,165

[45] Date of Patent: Oct. 28, 1986

[54] APPARATUS FOR CUTTING OFF PIECES FROM WIRE COMB BINDING MATERIAL

[76] Inventor: Peter Renz, Unterm Stein 9, D-7072 Heubach-Lautern, Fed. Rep. of Germany

[21] Appl. No.: 688,592

[22] Filed: Jan. 3, 1985

[30] Foreign Application Priority Data

Jan. 25, 1984 [DE] Fed. Rep. of Germany ..... 3402353

[51] Int. Cl.[4] ..... B26D 5/22

[52] U.S. Cl. ..... 83/246; 83/251; 83/275; 83/278; 83/423

[58] Field of Search ..... 83/423, 278, 275, 273, 83/228, 227, 250, 251, 246, 263; 193/35 A, 35 B; 188/83; 226/76, 144, 146, 148; 221/71

[56] References Cited

U.S. PATENT DOCUMENTS

| | | | |
|---|---|---|---|
| 749,031 | 1/1904 | Creed | 83/228 X |
| 2,444,485 | 7/1948 | Aitcheson | 188/83 X |
| 3,625,099 | 12/1971 | Mase et al. | 83/278 X |
| 3,655,109 | 4/1972 | Stevens | 226/76 X |
| 3,831,470 | 8/1974 | Maroschak | 83/423 X |
| 3,838,619 | 10/1974 | Brotman et al. | 83/423 X |

FOREIGN PATENT DOCUMENTS

| | | | |
|---|---|---|---|
| 8101546 | 6/1981 | PCT Int'l Appl. | 193/35 A |
| 283976 | 10/1971 | U.S.S.R. | 83/275 |

*Primary Examiner*—James M. Meister
*Attorney, Agent, or Firm*—Wells & Wells

[57] ABSTRACT

An apparatus with a cutting device for cutting-off pieces of a wire comb binding material for binding packs of sheets with marginal perforation. The pieces to be cut-off from the material shall have an entire number of teeth. The apparatus has a guide and a conveying wheel for the material. A brake or a catch provides for the pitch-correct cutting of the material. An adjusting device for adjusting the conveying length is provided in the drive connection to the conveying wheel. For this purpose a sector gear wheel comprises partial sector gear wheels. These are rotatable and capable of being fixed with respect to one another. Alternatively, an eccent arrangement may be used for adjusting the conveying length. The radial eccenter distance of the arrangement is adjustable. A chain driven thereby is itself driving a chain wheel, which on its turn drives a catch wheel for driving the conveying wheel.

2 Claims, 9 Drawing Figures

82
80
78
77
37
70
74
1'
86
110
116
102
118
120
114
124
122
70
77
74
76
84
103
104
106
108
14
53
7
52
11
112
1'

APPARATUS FOR CUTTING OFF PIECES FROM WIRE COMB BINDING MATERIAL

BACKGROUND OF THE INVENTION

The invention relates to an apparatus with a cutting device for the cutting pieces of a wire comb binding material for the binding of packs of sheets having marginal perforation, wherein the pieces cut off have a selectable number of teeth. The apparatus has a guide and a conveying wheel for the material with conveying teeth in a pitch adapted to material, and in the drive connection to the conveying wheel there is an adjusting device for adjusting the conveying length. From wire comb binding material (hereinafter often referred to just as "material"), as shown in FIG. 2 and serving for the binding of packs of sheets with marginal perforation, pieces with an entire number of binding teeth are to be cut off.

From the European patent application No. 0 041 249 an apparatus having a binding device is known, which is useful to bind a pack of sheets with marginal perforation under utilization of wire comb bindings. Within such an apparatus a device is provided for the advancing and separating of the wire comb binding material.

The present invention relates to an apparatus which does not serve the binding itself, but shall be supplied to bookbinder firms, who bind packs of sheets having marginal perforation by a relatively simple apparatus. Such firms require for the binding of determined sheets, e. g. of calendars, pieces of the material of a determined length, i. e. with a determined number of binding teeth. Up to now there are just two possibilities to provide pieces of determined selectable lengths. Either the pieces are cut off in the workshop of the bookbinder from endless material by hand, e. g. by means of a sheet cutter, or pieces of determined lengths are supplied by a manufacturer of the binding material. In the first case, much manual work is necessary. In the second case, it is necessary for the bookbinder firm to have relatively much material of different lengths in stock. Both cases are uneconomical.

SUMMARY OF THE INVENTION

By the present invention, the one hand, the labor-intensive cutting off by hand shall be avoided, on the other hand, it shall be avoided to store different lengths of binding material pieces. An apparatus shall be provided which renders it possible for the bookbinder firm to cut in each case from endless material pieces of the length needed at the moment, in fact, just as many pieces as are required for the execution of an order.

This object is solved according to the following:

The apparatus has a guide, e. g. in the form of a groove, and a conveying wheel for the advancing of a determined piece of selectable length of the material. Furthermore, a device for the adjusting of the conveying length is provided. Thus, material pieces of any selectable quantity of binding teeth can be conveyed and cut off.

Thereby any bookbinder workshop is in a position itself to cut off from the endless material which can be purchased at a favorable price the desired number of pieces according to the special requirements, in an economical manner.

FURTHER DEVELOPMENTS OF THE INVENTION

According to one embodiment of the invention the conveying device may be provided with a brake, which avoids an accidental and undesired advancing or returning of the material. A drive for the advancing of the material is dimensioned in such a manner that same surmounts the braking effect.

In addition to or instead of that, according to another embodiment, a pitch-oriented arrest may be provided, which prior to each cutting operation effects that the cutting position is situated between two binding teeth.

According to yet another embodiment the adjustment of different conveying widths can be solved in such a manner that a group of toothed wheels is provided which comprise teeth merely in one sector and are rotatable in regard to one another and are fixable so that one may set any conveying lengths. In this connection in each case one tooth of the partial sector gear wheels corresponds to one binding tooth of the material.

The problem may be solved also in a different manner, namely according to still another embodiment. Accordingly for the drive a chain is provided, which drives a chain wheel and, thus, the conveying wheel for the material. An adjusting device for the conveying path of the chain is inserted into the drive connection from a crank handle or a motor.

According to a further embodiment the adjusting device may be represented by an eccentric arrangement, wherein the radial distance of an eccentrically arranged part, which drives further parts and, thus, the chain, is adjustable.

BRIEF DESCRIPTION OF THE DRAWINGS

Embodiments with further features of the invention will be described hereinafter with reference to the drawings.

DESCRIPTION OF THE PREFERRED EMBODIMENTS

Figure 1:
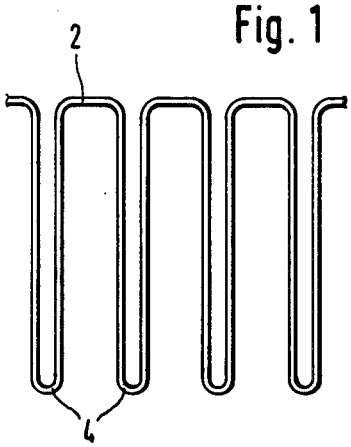
FIG. 1 shows, as a top view, a wire comb.
Figure 2:
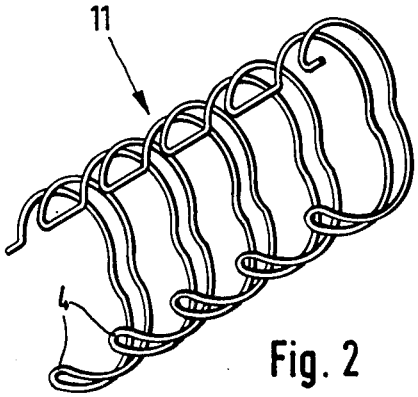
FIG. 2 shows a piece of a wire comb binding material bent therefrom.

FIG. 1 shows a plane structure bent from wire, a wire comb 2, from which wire comb binding material results by further bending operations, which comprises individual teeth, binding teeth, 4, which are pressed in a closing device through a marginal perforation of a pack of sheets and thereby hold the sheets together.

FIRST EMBODIMENT

Figure 3:
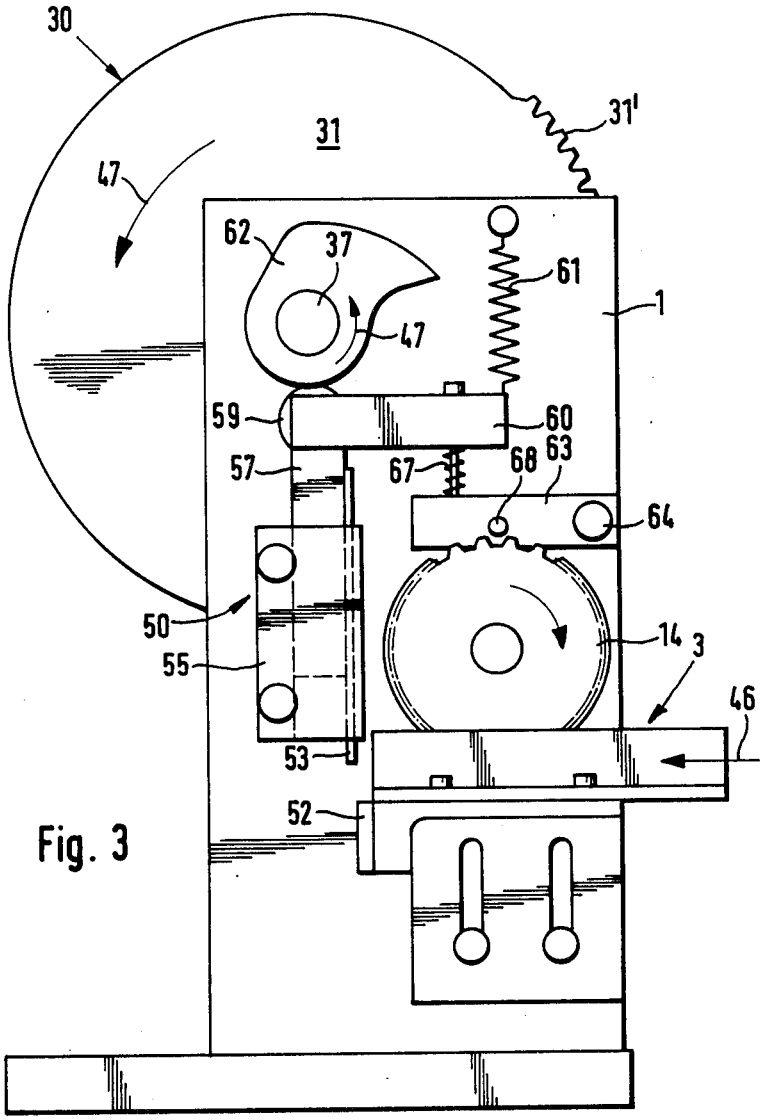
FIGS. 3 and 4 are side views of an apparatus according to a first embodiment of the invention in two different operating positions.
Figure 4:
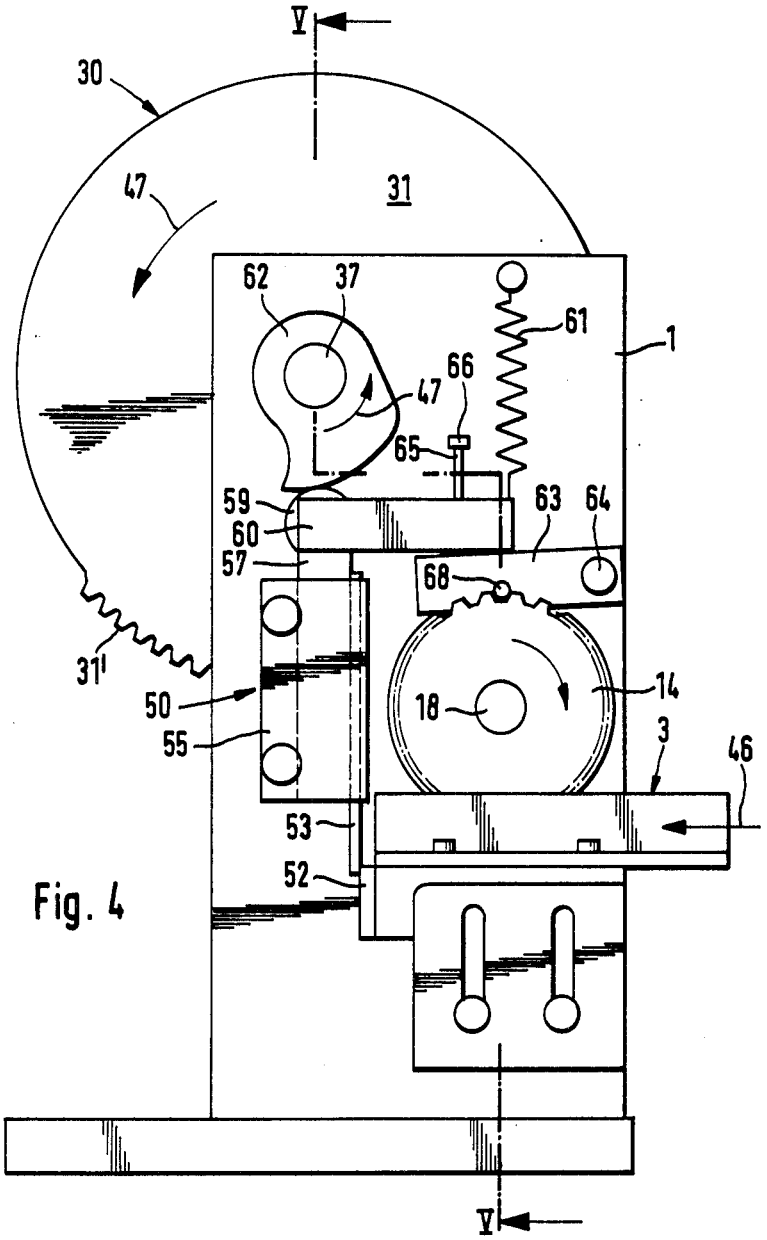
Figure 5:
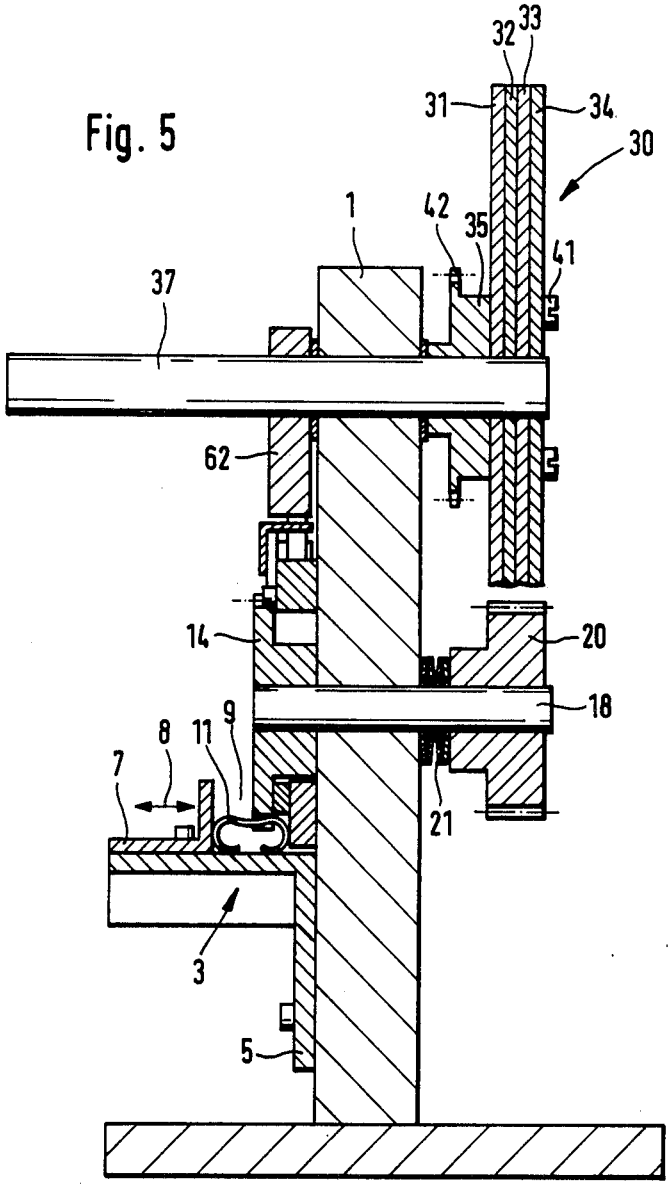
FIG. 5 is a cross-section through the same apparatus along a twice angled cutting line V—V in FIG. 4.

As shown by FIGS. 3 through 6, the apparatus has a stand or a frame 1, on which a guide 3 is provided for the initially endless wire comb binding material 11 (hereinafter referred to simply as "material"). This material can be supplied from a roll, not shown. It may be fed under the influence of gravity, or by a controlled drive, e. g. control of tension in the wire. The guide 3 is arranged on an angle profile 5, mounted on the frame 1, and in the cross-section has the shape, for instance, as shown in FIG. 5. A further angle profile 7 is adjustable and lockable in the direction of a double arrow 8 in FIG. 5. Thereby the guide may be adapted to a material of different width. Consequently, a groove 9 is provided having walls being arranged in parallel with each other, in which groove the material 11 can be conveyed. It is placed into such groove in such a manner that its open side is down below and a conveying wheel 14 may engage by its conveying teeth the closed side of the material from the top.

The conveying wheel has a tooth pitch, which fits into the pitch of the material 11. The conveying wheel 14 is provided in a rotationproof manner on a shaft 18, which is rotatably supported in the frame 1 and which carries, also in a rotationproof manner, on its right end, as seen in FIG. 5, a toothed wheel 20. Between this toothed wheel 20 and the frame 1 a brake 21 is provided on the shaft 18, in the form of cup springs, which may be compressed more or less strongly by adjustment of the toothed wheel 20 on the shaft 18. This brake allows the conveying wheel 14 an enforced rotation, but does not allow free rotation. This is essential for a defined advancing of a determined length of the material.

Figure 6:
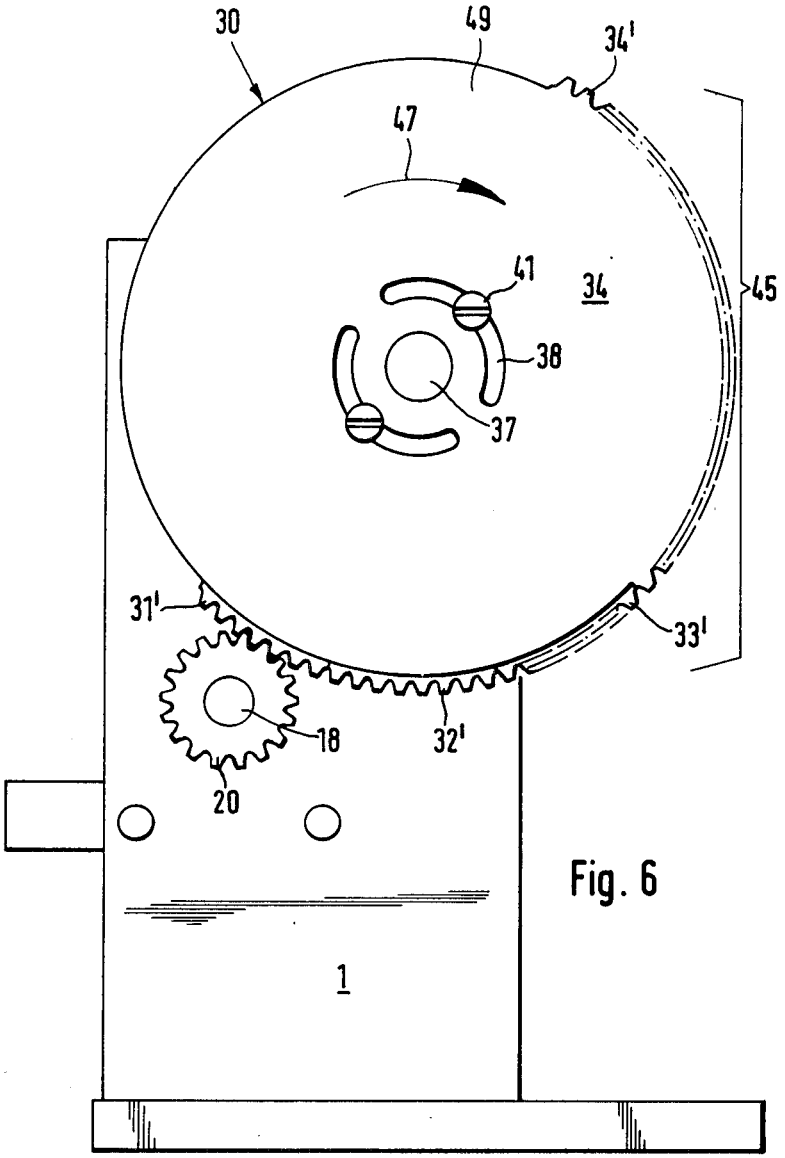
FIG. 6 is a view of a part of the apparatus from the right in FIG. 5, i. e. from the rear FIGS. 3 and 4.

A multipart sector gearwheel, as a whole designated by 30, serves for the drive of the two wheels. It consists of a plurality of, in the embodiment as shown of four part sector gear wheels 31 through 34, all of which are seated on a driving shaft 37. The part sector gear wheel 31, closest to the frame 1, is connected in a rotationproof manner with a collar 35 of the driving shaft. The part sector gear wheel 32 through 34 are rotatable in regard to the wheel 31 and in regard to one another. As shown in FIG. 6, they have semicircular slots 38 and can be tightened by means of screwing bolts 41 in regard to the collar 35. The driving shaft 37 may be driven by parts, not shown, e. g. by means of a crank or by a driving motor (e. g. with speed-regulated drive) via a chain and a chain wheel 42.

FIGS. 3, 4, and 6 show the entire sector gear wheel 30 in different rotational positions. The part sector gear wheels 31 through 34 each possess a toothed sector 31' through 34', i. e., a tooth system, which extends merely along one sector. FIG. 3 and FIG. 4 show just the toothed sector 31' of the part sector gear wheel 31, FIG. 6 shows all four toothed sectors. The tooth sectors preferably have different sizes. In the case of the embodiment as shown the toothed sectors 31' through 34' possess 8, 9, 10, and 28 teeth, respectively. Thereby, according to the adjustment of the toothed sectors in regard to one another, conveying paths of different length may be programmed. In addition, it is possible to remove one or more of the part sector gear wheels or exchange them for other wheels. All the wheels or the remaining wheels engage the toothed wheel 20 and, thus, serve for the drive of the conveying wheel 14 in each case for a larger or smaller part of a rotation of the driving shaft 37.

Each of the part sector gear wheels has in its region outside the toothed sector an extension, which is smaller than the root circle of the teeth. The boundary of this part of the part sector gear wheels may possess circular shape or any other shape.

As long as teeth of the entire sector gear wheel 30 engage the toothed wheel 20, the material 11 (wire comb binding material) is advanced in the direction of the arrows 46 in the FIGS. 3 and 4 within the guide 3 by the conveying wheel 14. As soon as the entire gear rim 45, which rotates in the direction of the arrow 47 in FIG. 6, up to its rearward end 49, has driven the toothed wheel 20, the entire sector gear wheel 30 rotates idle, whilst the shaft 18 is stopped immediately by the brake 21. Thus, the advance of the material through the guide 3 is stopped.

The material has been advanced beyond the left end of the guide 3 (FIGS. 3 and 4). Now it is necessary to cut off the advanced part. A cutting device as a whole designated by 50 serves this purpose. Same has a stationary blade 52, the upper edge of which is flush with the bottom of the groove 9, as well as a movable blade 53. The movable blade is seated on a stamp 57 and is guided perpendicularly displaceably in an apparatus-fixed blade guide 55. The stamp carries on top a freely rotatable ball bearing 59. On the upper end of the stamp a transversely projecting arm 60 is fastened. A tension spring 61 is mounted with its lower end on the arm 60 and with its upper end on the frame 1. Same is eager to pull the stamp 57 and, thus, the movable blade upwards.

On the driving shaft 37 a cam wheel 62 is provided in a rotationproof manner. Same takes up work, after the entire gear rim 45 of the sector gear wheel has stopped to drive the conveying wheel 14. Then the cam wheel moves the stamp 57 and, thus, the blade 53 downwards so that finally it cuts off the advanced material.

Due to the fact that the distance between the centers of two binding teeth in each case corresponds to one pitch of the gear rim 45 and of the conveying wheel 14 and that the shaft 18 is stopped immediately after the running through of the gear rim, always an entire number of teeth of the material is advanced so that the material always is cut between two teeth.

In addition or instead of the brake 21 the material can be adjusted to the space between two binding teeth at the cutting position in the following manner: An arm 63 is freely rotatable about an axle 64, which is mounted on the frame 1. On this arm a bolt 65 is fastened, which extends upwards through an opening of the arm 60 and carries a head 66 on top. At the end of the upward movement of the arm 60 under the influence of the tension spring 61 the arm 63 is taken along upwards. In the upward movement of the arm 60 under the influence of the cam wheel 62 the arm 63 is pushed downwards by means of a helical pressure spring 67, which surrounds the bolt 65. The arm carries a cylindrical pin 68, which, in the power position of the arm 63, engages a tooth gap of the conveying wheel 14 and adjusts same into a position, where a gap (of the conveyed material) is situated between two binding teeth at the cutting position.

When driving the shaft 37 in the direction of the arrows 47 the material is advanced in each case a determined distance. The length of this distance corresponds to the number of the teeth of the entire gear rim 45. If a brake 21 is provided, then same stops the shaft 18 subsequently. After the termination of the advance, i. e. generally a determined free angle of rotation thereafter, the cam wheel 62 pushes the movable blade downwards. When the effective portion of the curve rotational movement begins, the pin 68 engages a gap between two teeth of the driving wheel 14 and, thus, adjusts same and the advanced material. Subsequently, the blades cut off the advanced material piece. Then this operation is repeated.

By mutual adjustment of the part sector gear wheels 31 through 34, possibly by removal of one or more of these wheels, the apparatus can be adjusted to the desired length of the material pieces to be cut.

SECOND EMBODIMENT

Figure 7:
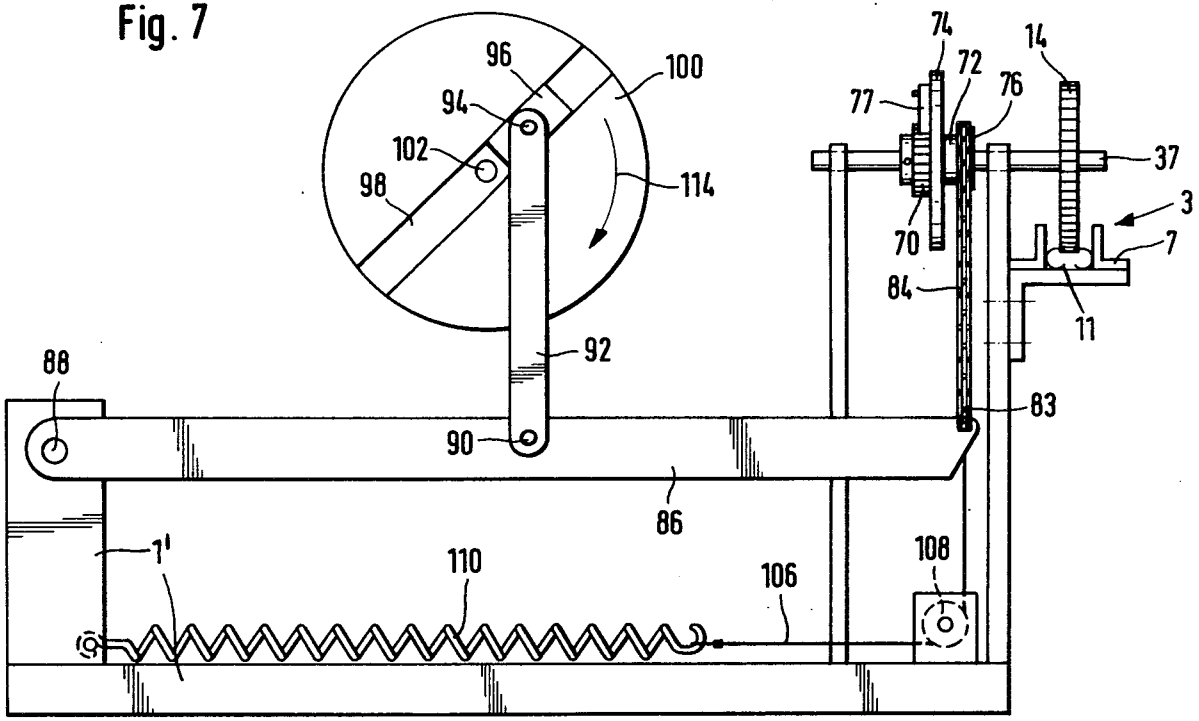
FIG. 7 shows an apparatus according to a second embodiment of the invention as a side view; the parts for the cutting of the finger binding are not are not shown therein.
Figures 8, 9:
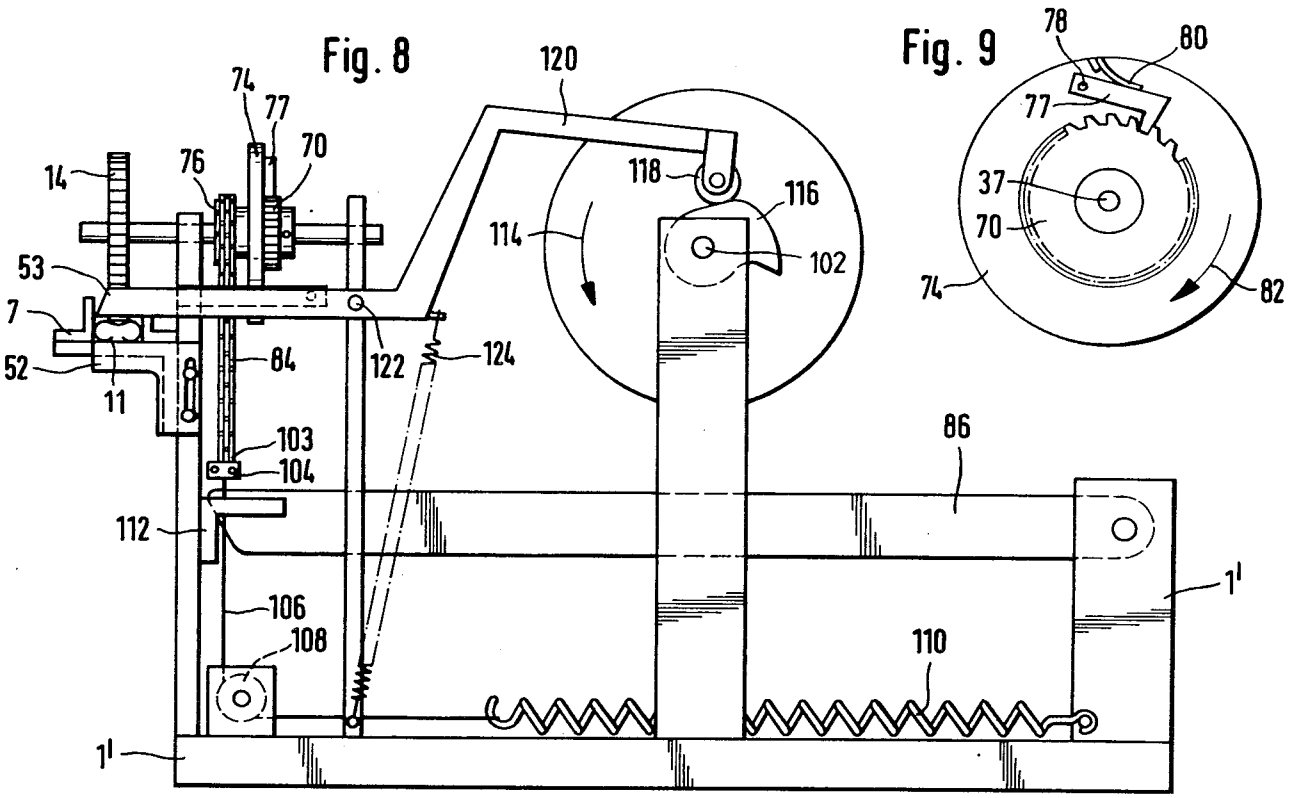
FIG. 8 shows the same apparatus as a rear view, i. e. in the opposite direction of the view according to FIG. 7, but with cutting device.
FIG. 9 shows a detail of the catch drive, seen from the left in FIG. 7.

In the case of the embodiment according to FIGS. 7 through 9 the transportation of the wire comb binding material by a determined adjustable distance is effected, instead of a sector gear wheel, by a conveying tooth and an associated chain drive, a radially adjustable eccentric arrangement making adjustable the extent of the conveying path.

On a frame 1 again a guide 3 is provided for the material. It is built up in the same manner, namely by angle profiles 7, as the guide according to the first embodiment. A conveying wheel 14 with conveying teeth provides for the advance of the wire comb binding material within the guide 3. The conveying wheel is seated, rotation-securely, on a driving shaft 37. On the same driving shaft a catch wheel 70 is seated rotation-securely, the tooth pitch of which is the same as the pitch of the conveying wheel 14. Each tooth of the catch wheel 70 and of the conveying wheel 14, therefore, corresponds to a binding tooth of the wire comb binding material.

A sleeve 72 is arranged freely rotatably on the driving shaft 37. A disc 74 and a chain wheel 76 are rotation-securely connected to same. On the disc 74 a catch 77 (FIG. 7) is pivotable about a pin 78 mounted on the disc 74. A spring 80, which is shown herein as a leaf spring, but may also be a helical pressure spring, keeps the catch 77 in engagement with the catch wheel 70. If the disc 74 is driven in the direction of the arrow 82, then it takes along the catch 77, and same takes along the catch wheel 70. The catch wheel is rotation-securely seated on the driving shaft 37, consequently drives same and, thus, the conveying wheel 14 in the direction of advance for the wire comb binding material. When the disc 74 returns in the opposite direction, the catch 77 carries out a rattle movement across the teeth of the catch wheel 70, consequently does not move same.

The chain wheel 76, rotation-securely connected to the sleeve 72, is driven by a chain 84 of endless length. The first end 83 of the chain is fastened to the one end of a lever 86. The lever 86 is pivotable about an axle 88, which is firmly connected to the frame 1 . Approximately in its center the lever is articulated by an axle 90 to kind of a connecting rod 92. The connecting rod is articulated on its other end by an axle 94 to a slide 96. The slide is displaceable within a groove 98 of a disc 100 and is fixable by means, not shown. The disc 100 is rotation-securely connected to a driving shaft 102. Same may be driven by means of a crank by hand or by a motor.

FIG. 8 shows the rear end, seen from FIG. 7, of the chain 84. It is firmly connected, by means of a clamp 104, or the like, to a tension element 106, for example a string or a wire rope. The tension element is guided via an apparatus-fixed roller 108, and its other end is connected to a tension spring 110, the other end of which is fastened on the frame 1'.

An angle piece 112, or the like, which is fastened on the frame 1', limits the downward movement of the clamp 104 and, thus, of the chain 84.

On the driving shaft 102, a cam wheel 116 (FIG. 8) is seated rotation-securely, which acts upon a lever 120, provided with a roller 118. The lever is swingable about an axle 122, which is stationarily provided on the frame 1'. The free end of the lever carries the movable blade 53, which acts together with the stationary blade 52 as in the case of the first embodiment, and which cuts off the advanced piece each of the wire comb binding material. For the return movement of the lever 120 a tension spring 124 is provided, the one end of which being firmly connected to the lever 120, in FIG. 8 to the right from the axle 122, and the other end of which being firmly connected to the frame 1'.

Also in the case of this embodiment a brake is provided, which may stop the conveying wheel, but may be surmounted by the drive. The brake is not shown on the drawings.

FUNCTION OF THIS APPARATUS

The driving shaft 102 is driven in any manner so that same turns the disc 100 in the direction of the arrow 114. Via the connecting rod 92, in the position according to FIG. 7, the lever arm 86 is pushed downwards. Thereby same pulls the chain 84 downwards on its first end 83 and turns the chain wheel 76, the sleeve 72, and the disc 74 in the direction of the arrow 82 in FIG. 9. Consequently, the catch 77 takes along the catch wheel 70 in the direction of the arrow 82. Due to the fact that the catch wheel is rotation-securely connected to the driving shaft 37, the conveying wheel 14 is taken along and conveys the wire comb binding material, as long as the lever arm 86 runs downwards, i. e. till the slide 96 reaches its lowest position in the rotation of the disc 100. Subsequently, the lever arm 86 moves upwards, and the chain 84 is pulled downwards by the spring 110 via the tension element 106 from its second end 103 (FIG. 8). The return motion of the chain is finished, as soon as the clamp. 104 contacts the angle piece 112.

After the advance of a piece of wire comb binding material is finished, via the cam 116, the lever 120 (in FIG. 8) is swiveled anticlockwise so that the blades 53 and 52 cut off the advanced piece of the material.

By displacement of the slide 96 (FIG. 7) in the radial direction, it is possible to adjust the advance width. On the disc 100, a scale, not shown, may be provided along the groove 98, which scale indicates, which slide position corresponds to an advance width by how many binding teeth.

The angle piece 112 provides for a defined end of the return motion of the chain 84, before the tension spring 110 is fully relieved.

What is claimed is:

1. An apparatus with a cutting device for the cutting of pieces of a wire comb binding material for the binding of packs of sheets having marginal perforation, wherein the pieces cut off have a selectable number of teeth, comprising:

(a) a vertical frame;

(b) a guide for said material mounted on said frame;

(c) a first shaft mounted for rotation on said frame and above said guide;

(d) a conveying wheel mounted on one end of said shaft and fixed thereto and having conveying teeth conforming in pitch to said selectable number of teeth and in cooperative relationship with said guide;

(e) a toothed wheel mounted on the other end of said first shaft and fixed thereto;

(f) a brake mounted on said first shaft between said conveying wheel and said toothed wheel;

(g) a second shaft mounted for rotation on said frame and above said first shaft defining a power shaft with sufficient force to overcome said brake;

(h) a sector gear wheel mounted and fixed thereto on one end of said second shaft, said sector gear wheel comprising a given number of teeth only in a sector of adjustable central angle, while, in the remaining sector, it has a radial extent, which is too small for an engagement of said toothed wheel, said given number of teeth driving said toothed wheel only when engaged therewith;

(i) cut off means mounted for reciprocation in a vertical plane on said frame incooperation with an end of said guide;

(j) a cam mounted on the other end of said second shaft with the cam surface thereof positioned at a central angle different from said given number of teeth and engaging said cut off means when said sector gear wheel is disengaged from said toothed wheel; and (k) a pivoted catch element engaging said conveying teeth and engaging said cam surface for preventing feed of said material during cut off.

2. The apparatus of claim 1, wherein said sector gear wheel is composed of, at least, two part sector gear wheels, which are arranged, side by side, on said second shaft, each comprising a part of the maximally necessary tooth sector, and which are rotatable in regard to one another for adjusting the conveying length, and which are rotation-securely connectable with one another and with said second shaft functioning as driving or driven element; and a gear rim of each of these part sector gear wheels engages said toothed wheel.

* * * * *